United States Patent [19]

Vertegaal

[11] 4,128,056

[45] Dec. 5, 1978

[54] PLASTICALLY DEFORMABLE, INELASTIC STENCIL END RING CONNECTION

[75] Inventor: Jacobus G. Vertegaal, Boxmeer, Netherlands

[73] Assignee: Stork Brabant B.V., Boxmeer, Netherlands

[21] Appl. No.: 765,777

[22] Filed: Feb. 4, 1977

Related U.S. Application Data

[63] Continuation-in-part of Ser. No. 582,814, Jun. 2, 1975, abandoned.

[30] Foreign Application Priority Data

Jul. 2, 1974 [NL] Netherlands ..... 7408974

[51] Int. Cl.[2] ..... B41F 15/38

[52] U.S. Cl. ..... 101/128.1

[58] Field of Search ..... 101/116, 127.1, 128.1, 101/119, 120

[56] References Cited

U.S. PATENT DOCUMENTS

| | | | |
|---|---|---|---|
| 3,110,919 | 11/1963 | Barnby | 101/120 X |
| 3,837,277 | 9/1974 | Jaffa | 101/127.1 |

FOREIGN PATENT DOCUMENTS

| | | | |
|---|---|---|---|
| 288446 | 3/1971 | Austria | 101/128.1 |
| 2241106 | 2/1974 | Fed. Rep. of Germany | 101/127.1 |

*Primary Examiner*—Ronald E. Suter

*Attorney, Agent, or Firm*—Edmund M. Jaskiewicz

[57] ABSTRACT

A cylindrical stencil for screen printing consisting of a perforated thin-walled sleeve with a rigid end ring at both ends; each of said rings being connected to a supporting member via a connection excluding any play in rotational direction, said connection comprising a member of plastically deformable material.

5 Claims, 9 Drawing Figures

PLASTICALLY DEFORMABLE, INELASTIC STENCIL END RING CONNECTION

RELATED APPLICATION

This application is a continuation-in-part of the copending application Ser. No. 582,814 filed June 2, 1975, now abandoned.

BACKGROUND OF THE INVENTION

My invention relates to a cylindrical stencil for a rotary screen printing machine with a thin-walled screen sleeve with two end rings and a connection between an end ring and a driving member, this connection being movable but free from play in the direction of rotation. The invention relates particularly to the supporting structure of such a stencil which is suspended at both ends in a rotatable support in the frame of the machine.

Screen printing stencils, consisting of a thin perforated metal foil which is easily deformable, are generally secured on rigid end rings and mounted with these end rings in the printing machine. It is essential that the connection upon the end rings and the mounting in the printing machine are effected with great precision. When the stencils are mounted slightly askew, a varying tensile force will occur during the printing operation owing to the rotation of the stencils. Apart from inaccuracies in the printing process itself, this incorrect mounting will cause a considerable reduction in the lifetime of the stencil.

DISCUSSION OF THE PRIOR ART

In order to avoid the consequences of an incorrect mounting of the stencils one has tried to secure the stencil-end ring, directly or indirectly, resiliently to the stencil holder; see U.S. Pat. No. 3,596,595 and Austrian Pat. No. 288,466.

In these known structures elastically deformable materials are used such as springs or rubber rings, respectively. This leads finally to a straight mounting indeed, so that when the resilient connection is applied at the location of the "incorrect mounting" inaccuracies in printing are avoided. The elastically deformed rubber rings or springs produce, however, varying forces along the circumference of the stencil, so that the stencil is still subjected to an uneven load causing its lifetime to be impaired.

SUMMARY OF THE INVENTION

The present invention provides a construction which produces ultimately a straight mounting without an uneven load being applied to the stencil. For that purpose the connection between the end ring secured to the stencil sleeve and the driving member, is provided with a member of plastically deformable material. The end ring of the stencil may be divided into two parts between which a deformable ring or hose filled with a liquid can be placed.

SURVEY OF THE DRAWINGS

DESCRIPTION OF PREFERRED EMBODIMENTS

Figure 3:
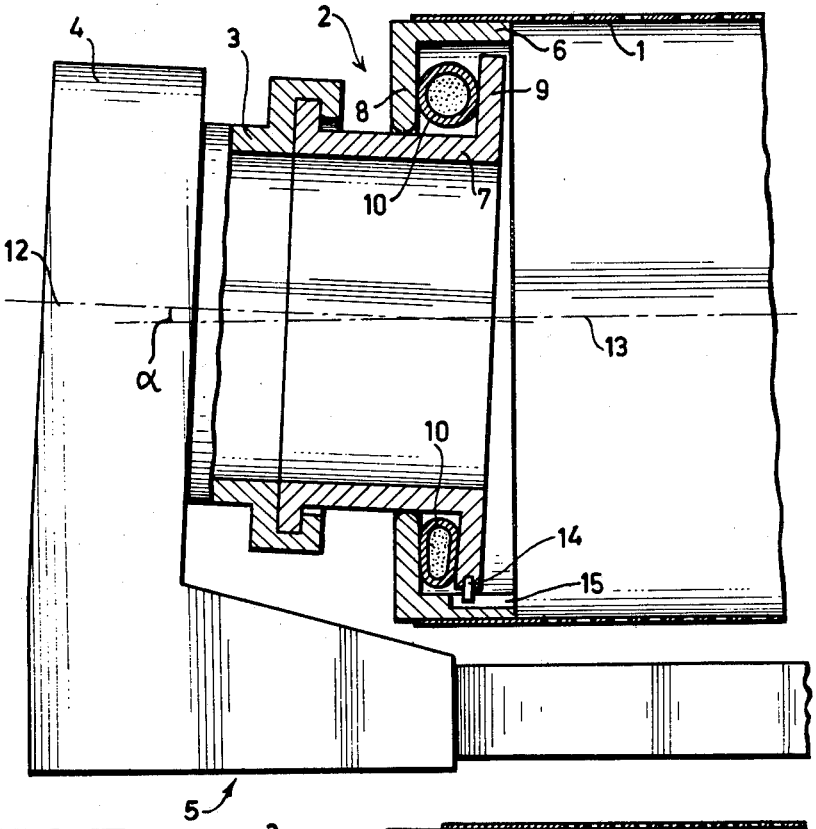

The supporting structure for the screen printing stencil in question can be used in a rotary screen printing machine, such as for instance in my Patent Application Ser. No. 383,155 filed on July 28, 1973 issued as U.S. Pat. No. 3,933,093 on Jan. 20, 1976, and in Pat. Nos. 3,678,571, 3,718,086, 3,420,167 and 3,304,860 and in Netherland Pat. Nos. 133,143 and 136,020. In machines as described in these patents, stencils are used consisting of a thin-walled screen sleeve 1 with two end rings 2. The driven end of each stencil is coupled to a driving member 3 which is rotatably journalled in a support 4 forming part of the frame 5 (see FIG. 3) of the machine.

Figure 4:
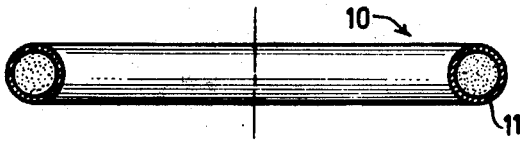
FIGS. 4 to 6 represent a diagonal section through an annular connecting member which is plastically deformable.
Figure 5:
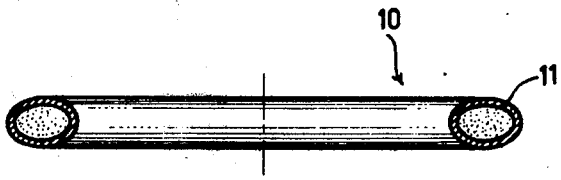
Figure 6:
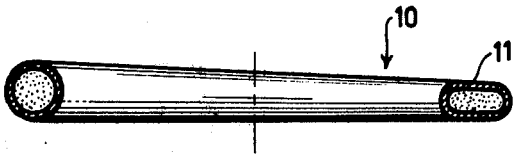

In the embodiment according to FIGS. 1–3 and 9, the end ring 2 consists, on the driven side of the stencil, of two coaxial parts 6 and 7 each provided with a flange 8 and 9, respectively, between which a plastically deformable connecting member 10 is mounted. This member consists of an easily deformable hollow body or hose 11 of inelastic but easily deformable material such as a synthetic plastic material including vinyls and the like or reinforced fabric hoses such as fire and garden hoses. The hose is almost — about 90–98% — filled with a virtually incompressible substance, which may be a liquid, such as water. In this connection reference is made to FIGS. 4–6, FIG. 4 showing the situation in which the hose 11 is entirely filled with a liquid, water, so that it is almost resistant to deformation. Member 10 is therefore not suitable for employment in the supporting structure according to the invention. Part 7 of each end ring 2 constitutes, as it were, an intermediate member functioning as a connection between part 6 and the driving— or supporting member 3.

FIG. 5 shows connecting member 10 in a usable condition, hose 11 being not entirely filled, up to about 85–95% of the total inner volume of the hose, with liquid. This condition is achieved by slightly deforming the member when it is being filled. After the member has been closed, an object as shown in FIG. 5 is obtained, which is easily plastically deformable, see FIG. 6. This deformablility is realised due to a displacement and repositioning of the liquid. The material of hose 11 though being inelastic is nevertheless easily deformable, whereas the liquid itself is almost incompressible.

Figure 1:
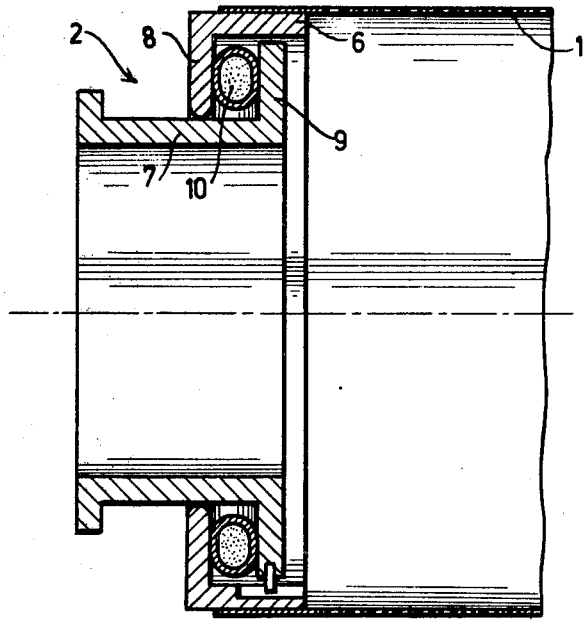
FIGS. 1 to 3 show a longitudinal section through a two-piece end ring structure at three different stages.
Figure 2:
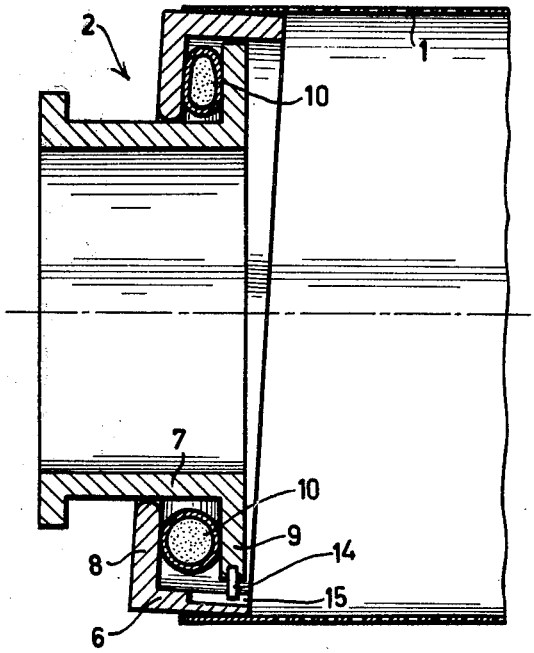

In the situation according to FIG. 1, the connecting member 10 corresponds with the shape as depicted in FIG. 5. In case of a slantingly inserted part 6 of end ring 2, such as represented in exaggerated form in FIG. 2, the connecting member 10 will take the configuration as represented in FIG. 6, some liquid being displaced from top to bottom. Owing to this plastic deformation an all round uniform load is applied during the tensioning of the stencil. As far as an obliquely inserted end ring is concerned, it would suffice to employ a plastic filling mass within the hose 11, since this mass need only to be displaced once.

My invention also provides, however, a compensation in case of an incorrect position of centerline 12 of the support 4 relative to the direction aimed at of centerline 13 of the stencil. This situation is exaggerated in FIG. 3 for purposes of clarity, the centerlines 12 and 13 intersecting each other at a small angle $\alpha$. Since this deformation does not rotate as is the case with the incorrect mounting according to FIG. 2, it is necessary that the plastically deformable material of the connecting member 10 can displace itself easily. For that purpose this filling mass is selected in such a way that it has the proper viscosity. Preferably the deformable connection is situated at the location of the adherence of the stencil sleeve 1 to the end ring 2, so that any oscillation is prevented during operation. In order to ensure that there is no play in the direction of rotation in the connection between driving member 3 and sleeve 1 of the stencil, one or more pins 14 are provided on flange 9 of part 7 of end ring 2, which engage correspondingly shaped grooves 15 in part 6 of the end ring and cooperate therewith.

Figure 7:
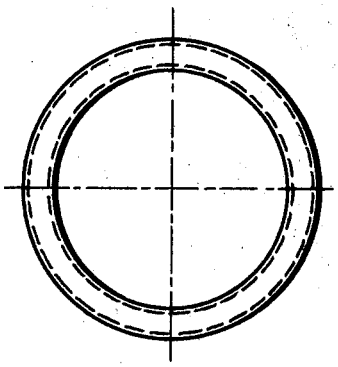
FIGS. 7 and 8 show two possible embodiments of the member according to FIGS. 4 to 6.
Figure 8:
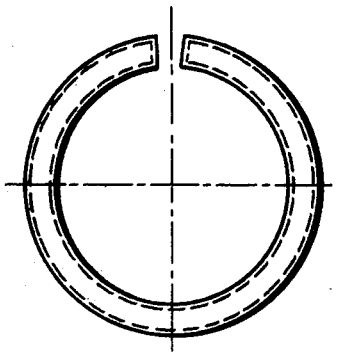

FIGS. 7 and 8 show two embodiments of the connecting member 10. According to FIG. 7 the member constitutes a closed ring, whereas this member according to FIG. 8, may also consist of a non-closed ring.

Figure 9:
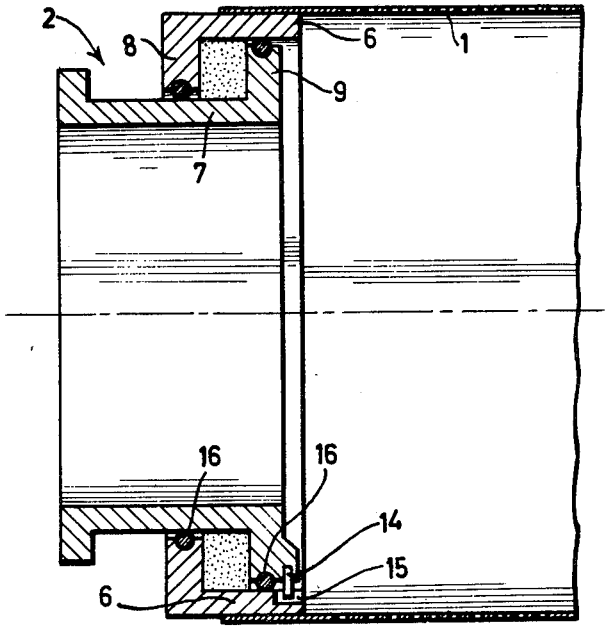
FIG. 9 is a modification of the embodiment according to FIGS. 1 to 3.

The embodiment according to FIG. 9 shows a possibility according to which the connection member 10 does not consist of a hollow body like the hose 11 as shown in the preceding FIGS. The plastically deformable material in this case is directly provided between parts 6 and 7 of end ring 2. The plastically deformable material may comprise polyvinyl resins which are inelastic but deformable, such as polyvinyl butyral resins, e.g. Butacite.

Flanges 8 and 9 comprise a sealing ring 16, preventing the plastic material from escaping from the annular space, surrounded by parts 6 and 7.

It is pointed out that the metal lead can also be used as the connecting member 10 and the embodiment of FIG. 9 since this material is also inelastic but easily deformable, lead also will retain its shape after it has been deformed.

Essential for the invention is that a compensation is provided for imperfections when mounting or supporting any stencil, which compensation is not based upon an elastic deformation but is achieved by a plastic deformability of materials as described above.

It will be understood that this invention is susceptible to modification in order to adapt it to different usages and conditions, and accordingly, it is desired to comprehend such modifications within this invention as may fall within the scope of the appended claims.

What is claimed is:

1. A cylindrical stencil for a rotary screen printing machine comprising a thin-walled screen sleeve and two end rings on the ends of said sleeve, at least one end ring comprising two coaxial parts each having a flange, a connection between said coaxial parts and said connection being movable but free from play in a direction of rotation of said sleeve and end rings, said connection comprising a plastically deformable inelastic member disposed between and in contact with said flanges such that a straight mounting of said cylindrical stencil with reference to the driving member is obtained without applying an uneven load to the stencil.

2. A stencil according to claim 1 wherein an end of said screen sleeve is positioned upon said one end ring to define a connecting area, said plastically deformable connecting member being disposed in a plane through the said connecting area between the screen sleeve and said one end ring.

3. A stencil according to claim 1 wherein said deformable member comprises an easily deformable hollow body of inelastic material, which is partially filled with an almost incompressible substance such as liquid.

4. A stencil according to claim 3, wherein said hollow body comprises a closed ring.

5. A stencil according to claim 3 wherein said hollow body comprises a ring having a gap therein.

* * * * *